United States Patent [19]

Reber

[11] 4,312,140

[45] Jan. 26, 1982

[54] DEVICE TO FACILITATE PEDESTRIAN LOCOMOTION

[76] Inventor: Walter Reber, 50, Rue du Marechal Foch, Saverne 6700, France

[21] Appl. No.: 134,785

[22] Filed: Mar. 28, 1980

[30] Foreign Application Priority Data

Apr. 3, 1979 [FR] France ..... 79 08877

[51] Int. Cl.[3] ..... A43B 7/06

[52] U.S. Cl. ..... 36/3 B

[58] Field of Search ..... 36/3 R, 3 A, 3 B, 25 R, 36/29, 136; 46/217

[56] References Cited

U.S. PATENT DOCUMENTS 3,225,463 12/1965 Burnham ..... 36/3 R 3,973,336 8/1976 Ahn ..... 36/3 B

*Primary Examiner*—Patrick D. Lawson

*Attorney, Agent, or Firm*—Ernest F. Marmorek

[57] ABSTRACT

A device to facilitate locomotion of a person moving by foot on the ground and adapted to be used in shoes worn by the person, wherein each shoe has a forward portion and a rearward portion, includes a first storage device for storing a certain amount of energy when one of the portions impacts with the ground, and a second storage device which communicates with the first storage means for receiving at least a portion of the energy stored in the first storage device, and for releasing at least a portion of the energy stored in the second storage device as the other portion is about to leave the ground, so as to aid the leaving motion.

22 Claims, 5 Drawing Figures

DEVICE TO FACILITATE PEDESTRIAN LOCOMOTION

BACKGROUND OF THE INVENTION

It is known that each step of a person moving on the ground involves a first phase in which one or the other of his feet first hits the ground with its heel, at a certain speed and with a certain weight. In the following phase of the same step, the impact of the force due, at least in part, to the action of body weight on the ground, and exerted in the first phase of the step on the heel, shifts forward towards the toes of the same foot. In the last phase of the step, when the bodyweight lies on the ball of the foot, the muscles of the leg provide an impulse to the foot to lift it from the ground. The more vigorous this impulse is, the easier or the greater is the velocity of locomotion of a person; the impulse is thus particularly indicative of a slow or fast motion.

It therefore seemed interesting to capture, at least in part, the energy which is lost in the first phase of the step of each foot, that is at the moment when the heel of a person hits the ground, and to return it in the sense of reutilization of this energy, at least in part, during the last phase of the step. Thus it is possible to allow a person advancing with more or less speed on the ground, to move more easily, in as much as the impulse provided by the muscles of each leg can be supplemented by the impulse produced by the device described in the present invention, and which, at the moment the foot of a person is about to leave the ground, releases a certain quantity of energy, which had been stored during the first phase of the step.

SUMMARY OF THE INVENTION

One of the principal objects of the invention is a device to facilitate locomotion of a person moving by foot on the ground and adapted to be used in shoes worn by the person, each shoe having a forward portion and a rearward portion, and including first storage means for storing a certain amount of energy upon one of the portions impacting with the ground, and second storage means communicating with the first storage means for receiving at least a portion of the energy stored in the first storage means, and for releasing at least a portion of the energy stored in the second storage means as the other portion is about to leave the ground, thereby aiding the leaving motion.

The invention also relates to a method of facilitating pedestrian locomotion of a person with the aid of a pair of shoes worn by the person, and of first storage means including resilient means, and of second storage means connected to the first storage means, and wherein each shoe has a sole, including an upper portion, and a heel, the locomotion cyclically including a first phase when the heel impacts with the ground, and a second phase when the sole makes contact with the ground, and the heel forms a predetermined angle with the ground. The steps include converting the kinetic energy given up by the heel at least partially to potential energy during the first phase, storing the potential energy, transfering the stored potential energy to the second storage means, reconverting the potential energy stored in the second storage means at least partially to kinetic energy in the form of an impulse thereby exerting an upward force on the upper sole portion during the second phase, and cyclically repeating the previous steps.

Further objects and advantages of the invention will be set forth in part in the following specification, and in part will be obvious therefrom without being specifically referred to, the same being realized and attained as pointed out in the claims hereof.

BRIEF DESCRIPTION OF THE DRAWING

For a fuller understanding of the nature and objects of the invention, reference should be had to the following detailed description, taken in connection with the accompanying drawings, in which.

DESCRIPTION OF THE PREFERRED EMBODIMENTS

Figure 1:
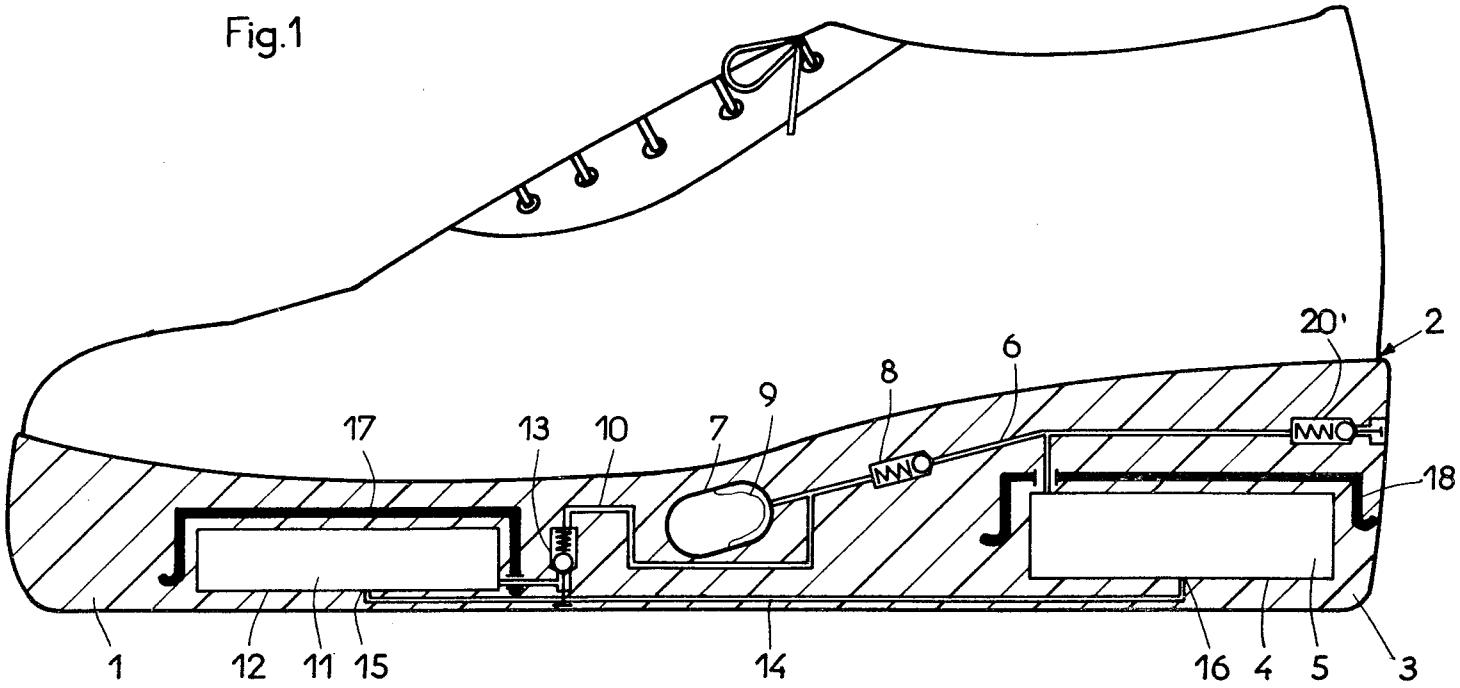
FIG. 1 is a lengthwise cross-section of a shoe, in the sole of which a device as described in the invention, is fitted.

Referring now to the drawings, and as shown on FIG. 1, the device described in the present invention is fitted in the sole 1 of a shoe 2, preferably a type of footwear used for walking. In the rear part of this sole 1, that is in the area of the heel 3, a cavity 4 is located, in which first means for storing kinetic energy is fitted. This first storage means consists of a reservoir 5, containing resilient means, such as a compressible fluid, for example air or another gas. This reservoir 5 can be made of a deformable material, such as, for example, rubber or a plastic material.

The reservoir 5 is connected through a first tube 6 to intermediate storage means, such as a pressure accumulator or storage cell 7. The tube 6 connecting the reservoir 5 and the accumulator 7, includes a one-way valve 8, so that the fluid circulating under a certain pressure from the reservoir 5 to the accumulator 7 can flow through in the direction of the arrow (f), best seen in FIG. 2, but is prevented from flowing back in the other direction.

The accumulator 7 includes two compartments. One compartment 7*a* contains, for example, an inert gas, such as nitrogen, whereas the other compartment 7*b*, which is separated from the first one by a membrane or diaphragm 9, may contain the fluid circulating in the various elements of the present device. This accumulator 7 is connected through a second tube 10 to a second storage means, such as a second reservoir 11 which is contained in a cavity 12 located in the front part of the sole 1, approximately in the area of the sole on which the ball of the foot presses. The tube connecting the accumulator 7 and the reservoir 11 includes a controlled one-way valve 13. As this one-way valve 13 is controlled, it permits the flow of the fluid from the accumulator 7 to the reservoir 11 in the direction of the arrow f', only under certain conditions and prevents the flow of the fluid in the other direction.

A third or feedback tube 14 which consists at least in part of a deformable material, connects the reservoir 11 and the reservoir 5 directly. The two ends of the tube 14 are inserted in the reservoirs 5 and 11 in the areas 15 and 16 in which the shoe is subject to deformation, so that the tube 14 can be shut through compression of the sole or that of the shoe 2. As distinct from the tube 14, the tubes 6 and 10 can be made of a nondeformable material. The tubes 6 and 10 are connected to the respective reservoirs 5 and 11 in an area where the reservoirs 5 and 11 are not deformable, even when exposed to an external force, or when a fluid under pressure flows in. For this purpose, the two reservoirs 5 and 11 are, at least on their upper portion, surrounded by a rigid shield, which can, for example, be a metal-sheet cover 17 or 18 placed around the cavities 4 or 12 which contain the reservoirs 5 and 11, respectively.

FIGS. 2 to 5 of the drawings show how the device of the present invention operates.

Figure 2:
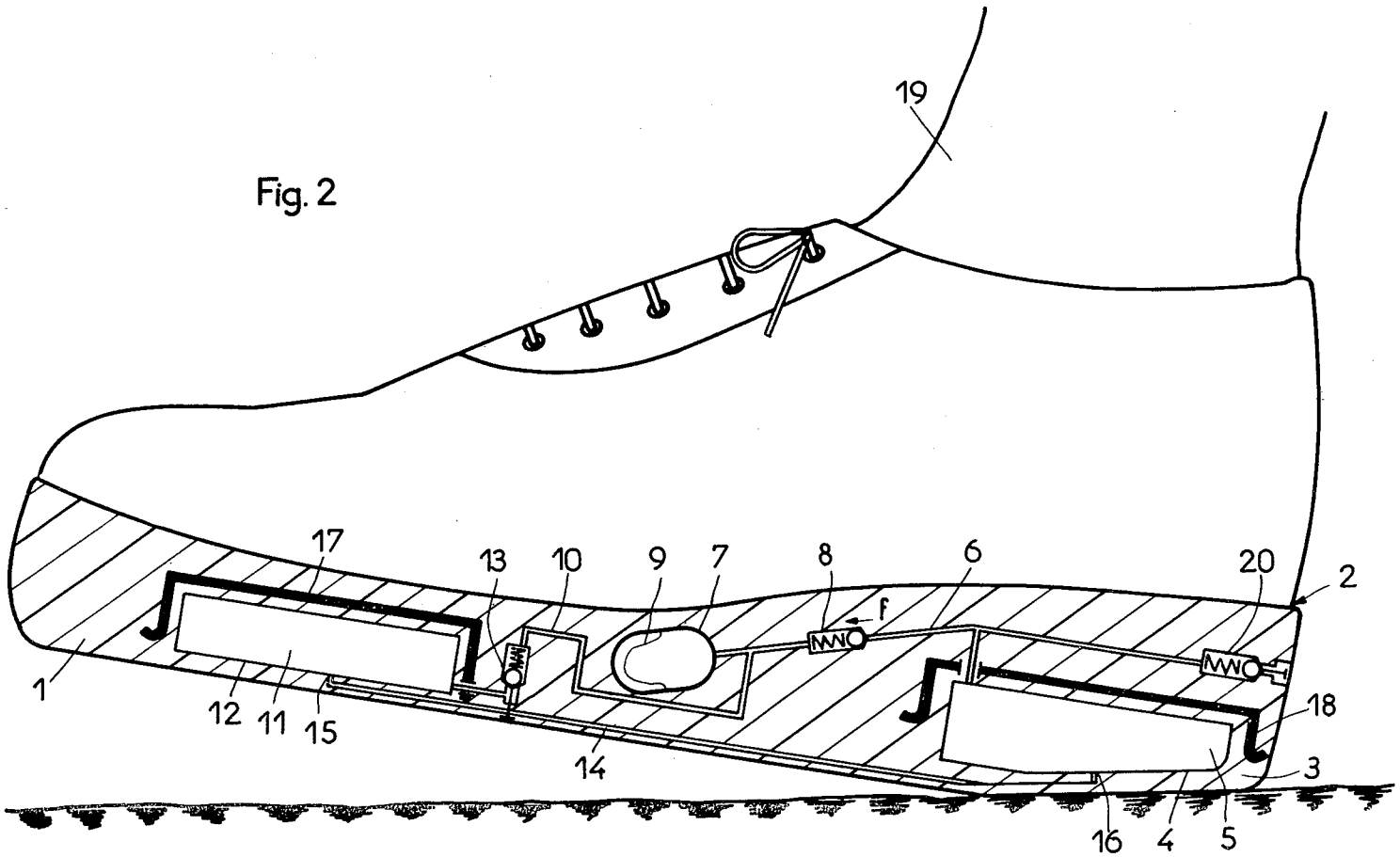
FIG. 2 is a view similar to FIG. 1, in which the device fitted in the sole of the shoe stores the kinetic energy produced by the heel hitting the ground.

FIG. 2 shows the shoe 2 at the moment when its heel 3 impacts with the ground at the beginning of a step, thus giving up kinetic energy. During this impact, the heel 3, made of a relatively elastic material, will be deformed, as it is being compressed. This deformation results at first in a closing of the tube 14, which is connected to the reservoir 5 in the lower part thereof, and subsequently in a deformation of the reservoir 5, whose inner volume then decreases. As a result of this decrease of volume, pressure inside the reservoir 5 increases; the kinetic energy given up by the heel motion will therefore be at least partly converted into potential energy in the form of fluid under pressure. As soon as this pressure reaches a certain value, the one-way valve 8 opens, so that the pressurized fluid under pressure can now flow through the tube 6 and be stored in the accumulator 7, while the controlled one-way valve 13 remains closed.

Figure 3:
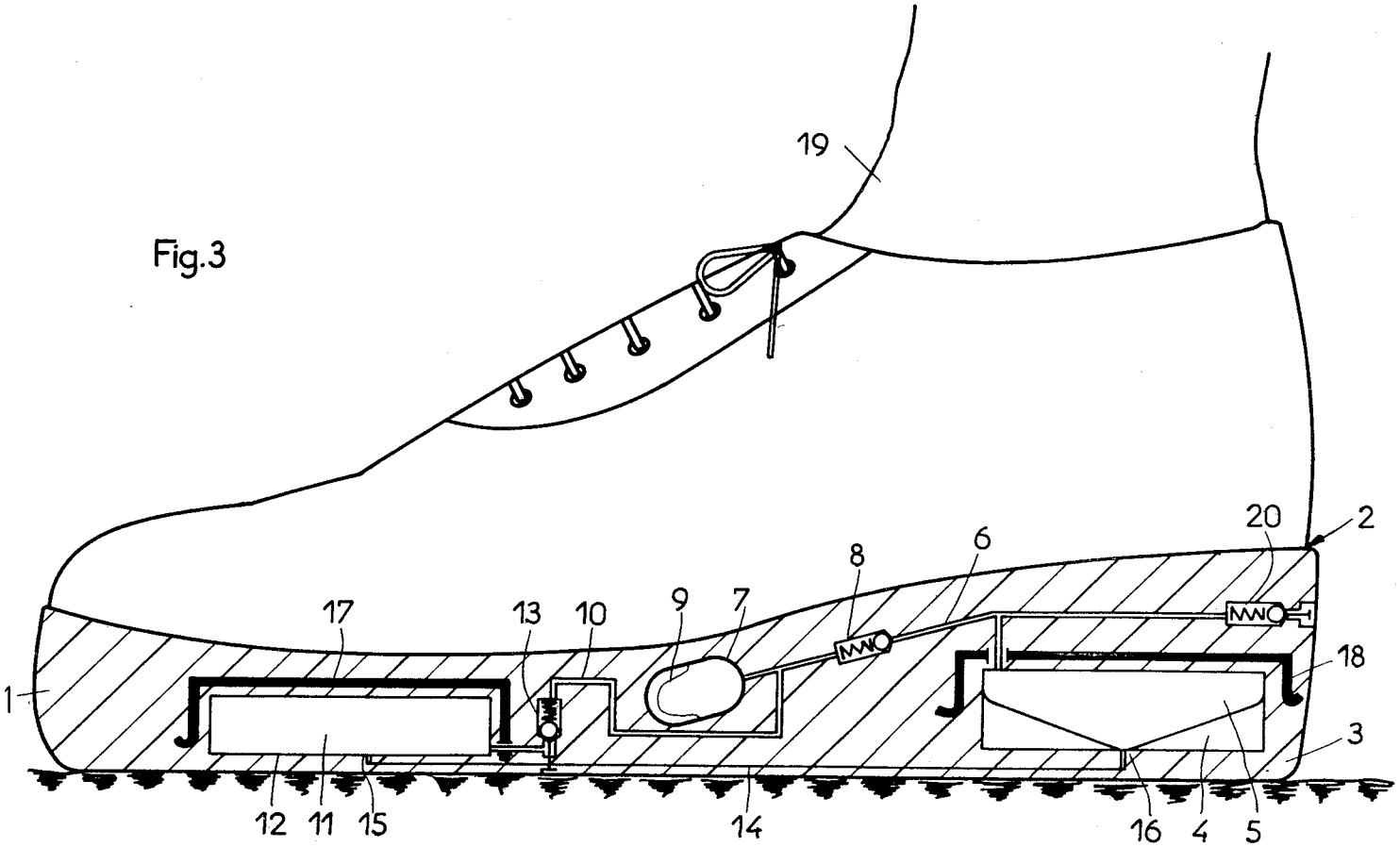
FIG. 3 is a view similar to FIG. 1, in which the kinetic energy due to the hitting of the ground by the heel is stored by the device described in the present invention.

When the fluid under compression is stored in the accumulator 7, the second phase of the step begins, during which phase the rear and front parts of the bottom part 1 of the shoe 2 are both simultaneously touching the ground, as shown in FIG. 3. During this second phase of the step, the device described in the present invention remains in the state reached at the end of the first phase, which means that a certain quantity of fluid under pressure is stored in the intermediate storage means, namely the accumulator 7. During this second phase of the step, the tube 14 is closed approximately over its whole length, due to the fact that part of the body-weight of the wearer is pressing equally on approximately the whole length of the bottom part 1 of the shoe 2.

Figure 4:
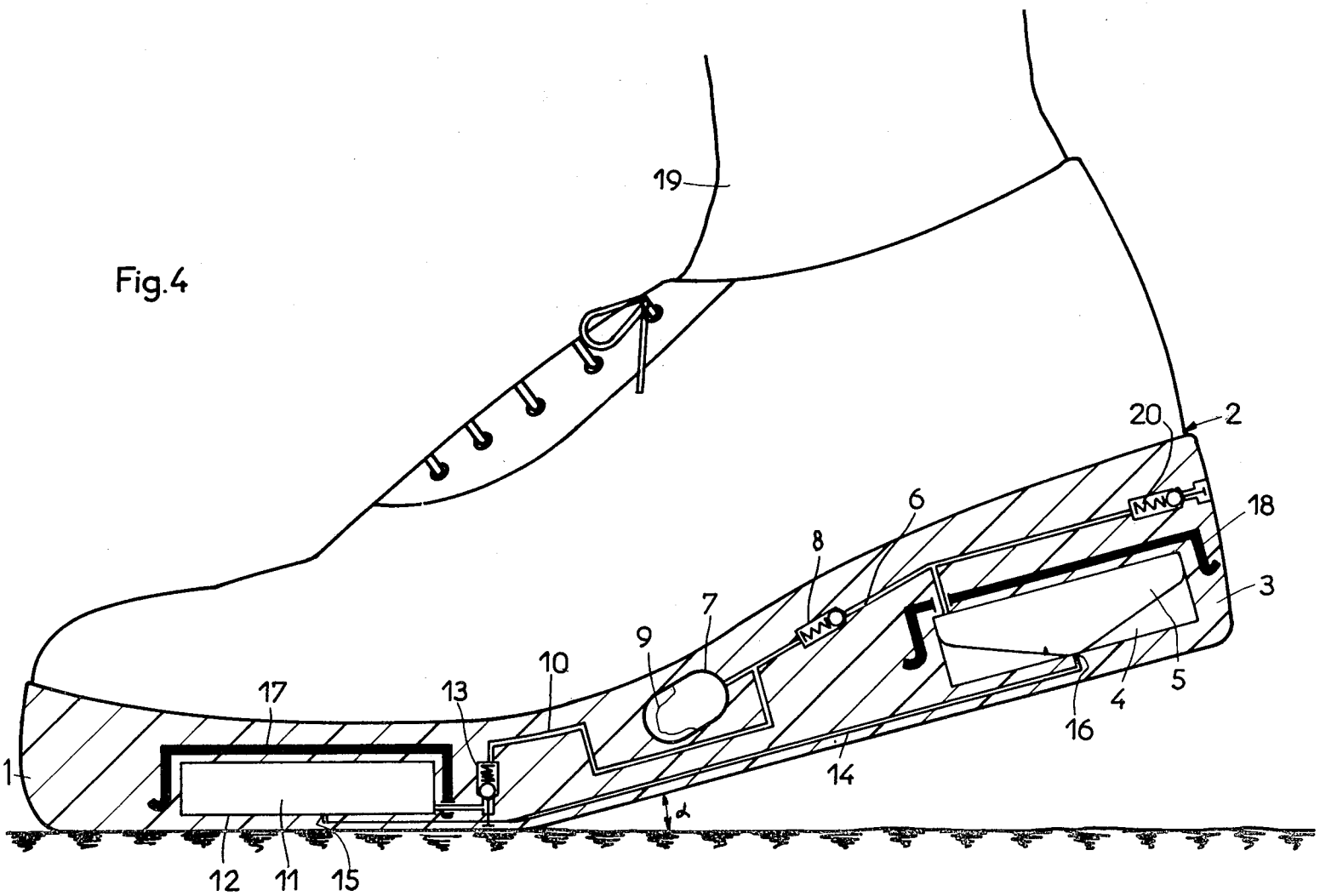
FIG. 4 is a view similar to FIG. 1 in which the device described in the invention is ready to release the stored energy.

FIG. 4 shows the third phase of the step during which, as the body of the wearer leans progressively forward, its weight is brought to bear on the ground by the front part or sole of the shoe 2. The shoe 2 is bent, so that its heel 3 rises to a certain height above the ground. During this phase of the step, the state of the device is unchanged with respect to the proceeding phase. However, the tube 14 connecting directly to the two reservoirs 5 and 11 is no longer closed, except in the area of the reservoir 11 located in the front part or sole of the bottom part 1 of the shoe.

When the position described in FIG. 4 is reached, the muscles of the leg 19 of the foot shod with the shoe 2 are ready to provide to the foot 2 an impulse urging it to leave the ground, thereby exerting a force on the upper sole portion, while pushing the body of the wearer forward. The device of the present invention provides for the addition of a further impulse to the above-mentioned muscle impulse.

Figure 5:
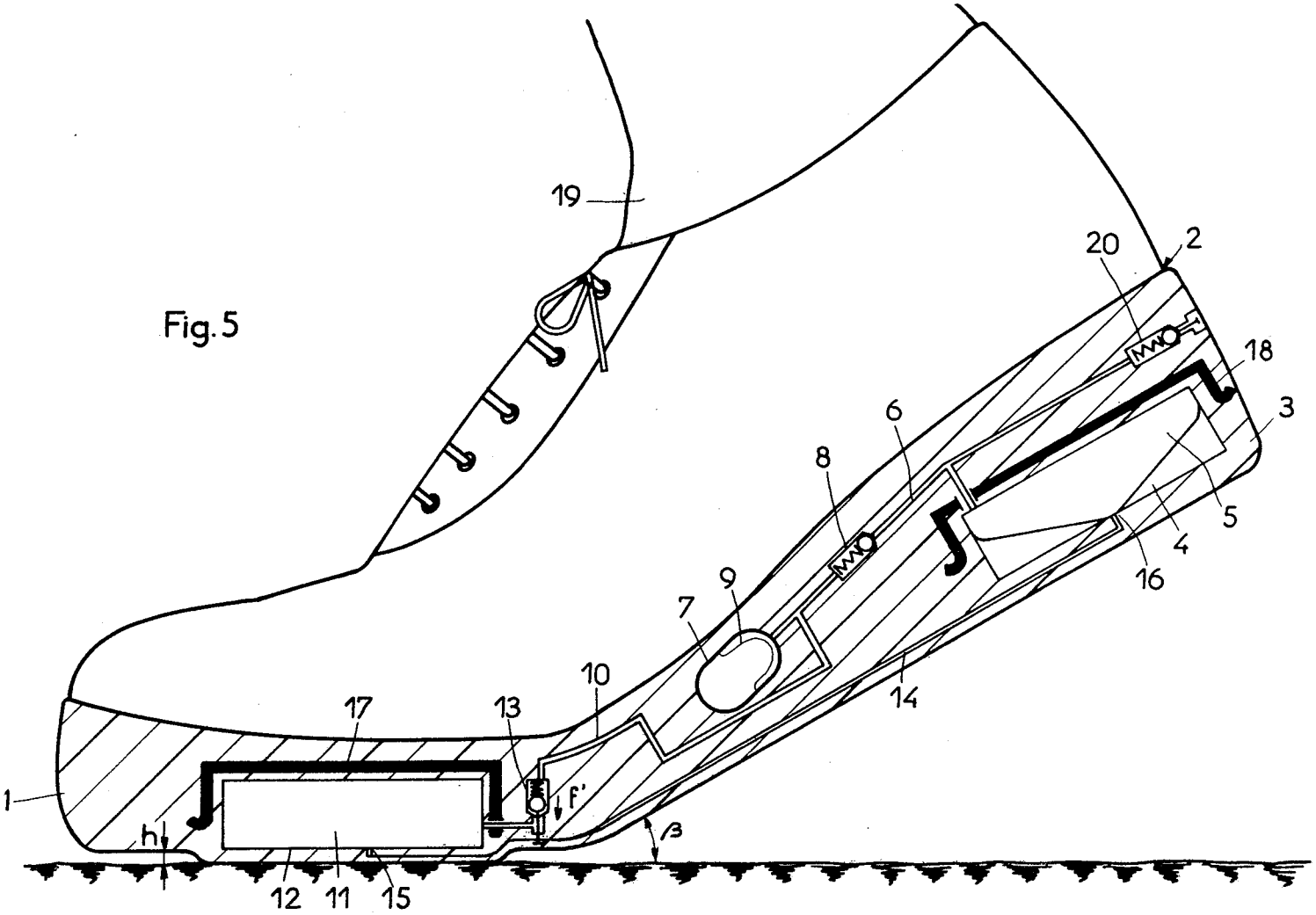
FIG. 5 is a view similar to FIG. 4, in which the device described in the present invention has released the stored energy.

The operation of this further impulse will be evident from FIG. 5 of the drawings. As seen in FIG. 5, the bottom part 1 of the shoe 2 forms an angle $\beta$ with the horizontal which is larger than the angle $\alpha$ shown in FIG. 4, because the body of the wearer, and consequently the leg 19 are leaning further forward. Because of the muscle impulse intended to make the foot shod with the shoe 2 leave the ground, there occurs an increase of pressure at the point of contact of that part of the bottom part 1 of the shoe 2 which touches the ground. As soon as this pressure reaches a predetermined value, the controlled one-way valve 13 opens. The fluid under pressure stored in the accumulator 7 then gushes into the second storage means, such as the reservoir 11, whose volume increases, and deforms the reservoir 11 in a direction at right angles to the ground, the shield 17 preventing a lateral deformation of the bottom part 1 of the shoe 2. This sudden increase of pressure produces in the bottom part 1 of the shoe 2 an upwardly directed impulse, away from the ground, which has the effect of lifting the shoe 2 by a height h, and consequently lifting the foot of the person wearing the shoe 2. As this impulse is provided in addition to the muscle impulse provided by the leg 19 of the wearer, the wearer can then either reduce his muscular effort without diminishing the quality of his step, or increase the quality of his step without increasing his muscular effort. Thus it will be seen that the potential energy stored in the second storage means has been reconverted to kinetic energy in the form of the impulse.

As has already been stated, the control of the one-way valve 13 is arranged so that it is opened when the pressure, at the point of contact of the bottom part 1 on the ground reaches a certain value. It is also possible to arrange for the control of the one-way valve 13 to be commanded by bending the bottom part 1 of the shoe, as soon as the angle $\beta$ formed by the rear part of the bottom part 1 of the shoe, and the ground reaches a given value.

It is clear that either the pressure at the point of contact, or the angle $\beta$, commanding the opening of the one-way valve 13, can be regulated by the person wearing the shoes 2, so as to adapt it to the type of motion he desires. It is also possible to arrange that the time duration during which the controlled one-way valve 13 is open can be regulated by a corresponding control in the shoe 2 being exteriorly accessible. Thus it is possible to regulate the magnitude of the impulse resulting from the decompression of the fluid previously compressed in the accumulator 7.

In the following phase of the step, the foot shod with the shoe 2 is no longer in contact with the ground and gets ready to impact with the ground again through the heel 3, as shown in FIG. 2. During this period, when the bottom part 1 of the shoe 2 is no longer deformed and has recovered its initial shape, the tube 14 is open, and connects the two reservoirs 5 and 11, so that an equilibrium of pressure between the two reservoirs 5 and 11 is reached, permitting them to be restored to their initial volume. The tube 14 which has acted as fluid transfer means, can be replaced by openings which lead directly from the reservoirs 5 and 11 to the surrounding air. These openings must be located approximately at the same locations 15 and 16 where the ends of the tube 14 would normally be inserted in the reservoirs 5 and 11, so as to be closed as soon as that part of the bottom part 1 of the shoe 2 touches the ground in the area of which the respective reservoirs 5 and 11 are located. To ensure an air-tight closing of these openings, (non-illustrated) valves are provided which close the openings when the parts 15 or 16, where the valves are located, are subjected to pressure.

It is clear that when the device described in the present invention operates, so that the parts 15 and 16 communicate with the surrounding air, that the pressure within the reservoirs 5 and 11 is equal to the atmospheric pressure, at least as long as the bottom part 1 of the shoe 2 does not touch the ground. On the other hand, the tube 14 which connects the two reservoirs 5 and 11 allows the application in the device of a pressure which is different from the atmospheric pressure, or the use of a fluid other than air. The embodiment featuring the tube 14 allowing a fluid to circulate in the closed circuit provided in the bottom part 1 of the shoe 2 at a pressure other than atmospheric pressure, offers the advantage that the "harshness" or "intensity" of reaction of the device may be adapted to the body-weight of the person wearing the shoes, and/or to the type of movement desired. It is indeed possible to provide the circuit comprising the tubes 6, 10 and 14 and the reservoirs 5 and 11 with an additional valve 20, which is accessible exteriorly, and which allows pressurization of the fluid contained in the aforedescribed circuit to a certain extent.

It is also possible, without deviating from the scope of the present invention, to eliminate the pressure accumulator 7. Its function is then taken over by the tubes 6 and 10, made in this case of an elastic material which allows deformation of the tubes, so as to store the energy captured when the reservoir 5 is being compressed, and to allow recovery of their initial shape when the energy is released from the reservoir 11, due to the appropriate action of the valves 8 and 13 as described above.

Furthermore, it is possible to inactivate the device described in the present invention, for example by blocking the one-way valve 8 in its closed position, so that it does not open even under increased pressure, due to the decreasing volume of the reservoir 5 at the moment when the heel 3 of the shoe 2 impacts with the ground.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

1. A device to facilitate locomotion of a person moving by foot on the ground and adapted to be used in shoes worn by the person, each shoe having a forward portion and a rearward portion, comprising in combination:

first storage means for storing a certain amount of energy upon one of said portions impacting with the ground, and second storage means communicating with the first storage means for receiving at least a substantial proportion of the energy stored in said first storage means, and for releasing at least a substantial proportion of the energy stored in said second storage means as the other of said portions is about to execute a lifting motion from the ground, so that the released energy acts in a direction to aid said lifting motion.

2. A device as claimed in claim 1, further comprising intermediate energy storage means connected between said first and second storage means and control means for transferring the stored energy between said storage means in dependence of the steps taken by the person wearing said shoes.

3. A device as claimed in claim 2, wherein said first and second storage means include at least partly deformable first and second fluid reservoirs, wherein said intermediate energy storage means is a storage cell, and further comprising a first tube connecting said first reservoir to said storage cell, and a second tube connecting said storage cell to said second fluid reservoir, and wherein said control means include a first valve interconnected between said first reservoir and said storage cell, and a second valve interconnected between said storage cell and said second reservoir.

4. A device as claimed in claim 3, further comprising a feedback tube connecting said first and second reservoirs.

5. A device as claimed in claim 1 wherein said forward portion is a sole of the shoe, and the rearward portion is the heal of the shoe, and wherein said first reservoir is disposed near the heel of the shoe, and said second reservoir is disposed near the sole of the shoe.

6. A device as claimed in claim 3, wherein said valves are one-way valves.

7. A device as claimed in claim 3, wherein said first and second valves are openable and closable in dependence of the pressure exerted on said forward and rearward portions, respectively.

8. A device as claimed in claim 3, wherein said sole is flexible, and wherein said second valve is openable and closable in dependence of the flexion exerted on said forward portion.

9. A device as claimed in claim 8, wherein said second valve is openable and closable, and wherein said forward portion is arranged to form a angle within a predetermined range with the rearward portion, said second valve being openable in dependence of said angle.

10. A device as claimed in claim 3, wherein said second valve is openable and closable, and wherein the time duration of the open state of said second valve is presettable.

11. A device as claimed in claim 10, wherein said second valve is disposed in the forward portion of the shoe, and further comprising regulating means for presetting the time duration of the open state of said second valve, said regulating means being accessible from the exterior of said shoe.

12. A device as claimed in claim 3, further comprising first and second substantially rigid shields at least partly surrounding said first and second reservoirs.

13. A device as claimed in claim 4, wherein said forward portion is the sole of the shoe, and the rearward portion is the heel of the shoe, at least a part of said sole and heel being deformable, and wherein said feedback tube is connected to said reservoirs near the respective deformable parts of said sole and heel, respectively.

14. A device as claimed in claim 2, wherein said control means further comprises fluid-pressure adjusting means.

15. A device as claimed in claim 13, wherein said fluid-pressure adjusting means is disposed near the heel of the shoe, and is exteriorly accessible.

16. A device as claimed in claim 4, wherein said tubes are made of elastic material.

17. A device for facilitating pedestrian locomotion of a person, and adapted to be used in each shoe worn by the person, each shoe having a sole, including an upper portion, and a heel, the locomotion cyclically including a first phase, when the heel impacts with the ground, thereby giving up kinetic energy, a second phase when the sole portion makes contact with the ground, and the heel forms a predetermined angle with the ground, and a third phase when both the sole and heel are substantially parallel with the ground, though lifted off the ground, comprising in combination:

first storage means adapted to hold a compressible fluid for converting the kinetic energy at least partially to potential energy during said first phase, whereby the compressible fluid stored in said first storage means is subjected to a pressure in dependence of said kinetic energy, second storage means communicating with said first storage means for receiving said compressible fluid under pressure from said first storage means during said second phase, and for reconverting the potential energy stored therein at least partially to kinetic energy in the form of an impulse, thereby exerting an upward force on the upper sole portion, and fluid transfer means for returning the compressible fluid stored in said second storage means to said first storage means during said third phase.

18. In a method of facilitating pedestrian locomotion of a person with the aid of a pair of shoes worn by the person, and of first storage means adapted to hold a compressible fluid, second storage means communicating with the first storage means for receiving the compressible fluid from said first storage means, and fluid transfer means for returning the compressible fluid from said second storage means to said first storage means, and wherein each shoe has a sole, including an upper portion, and a heel, the locomotion cyclically including a first phase when the heel impacts with the ground, thereby giving up kinetic energy, a second phase when the sole makes contact with the ground, and the heel forms a predetermined angle with the ground, and a third phase when both the sole and heel are substantially parallel with the ground, though lifted off the ground, the steps comprising:

(a) converting the kinetic energy at least partially to potential energy during said first phase, whereby the compressible fluid stored in said first storage means is subjected to a pressure in dependence of said kinetic energy, (b) reconverting the potential energy obtained in step (a) at least partially to kinetic energy in the form of an impulse thereby exerting an upward force on the upper sole portion, upon the compressible fluid under pressure being received in said second storage means during said second phase, (c) returning the compressible fluid stored in said second storage means to said first storage means during said third phase, and (d) cyclically repeating steps (a) through (c).

19. A device for facilitating pedestrian locomotion of a person, and adapted to be used in each shoe worn by the person, each shoe having a sole, including an upper portion, and a heel, the locomotion cyclically including a first phase, when the heel impacts with the ground, a second phase when the sole makes contact with the ground, and the heel forms a predetermined angle with the ground, comprising in combination:

first storage means including resilient means for converting at least a substantial proportion of any kinetic energy given up by the heel to potential energy during said first phase, and storing it in said first storage means, and second storage means connected to said first storage means for receiving at least a substantial proportion of the potential energy stored in said first storage means during said second phase, and for reconverting the potential energy stored in said second storage means during said second phase at least partially to kinetic energy in the form of a directional impulse exerting an upward force on the upper portion of the sole.

20. In a method of facilitating pedestrian locomotion of a person with the aid of a pair of shoes worn by the person, and of first storage means including resilient means, and of second storage means connected to the first storage means, and wherein each shoe has a sole, including an upper portion, and a heel, the locomotion cyclically including a first phase when the heel impacts with the ground, and a second phase when the sole makes contact with the ground, and the heel forms a predetermined angle with the ground, the steps comprising:

(a) converting at least a substantial proportion of the kinetic energy given up by the heel at least partially to potential energy during said first phase, (b) storing the potential energy obtained in step (a) in said first storage means, (c) transferring the potential energy stored in said first storage means to the second storage means, (d) reconverting at least a substantial proportion of the potential energy stored in said second storage means to kinetic energy in the form of a directional impulse exerting an upward force on the upper portion of the sole, during said second phase, and (e) cyclically repeating steps (a) through (d).

21. A device as claimed in claims 1, 2, or 3, further comprising a first valve communicating with said first storage means, and a second valve communicating with said second storage means, each valve being normally open to the surrounding air, and being arranged to close upon being subjected to pressure.

22. A device as claimed in claims 1, 2, or 3, further comprising a first valve communicating with said first storage means, and a second valve communicating with said second storage means, each valve being normally open to the surrounding air, and being arranged to close upon being subjected to pressure due to a corresponding portion of the shoe impacting with the ground.

* * * * *